US012077960B2

(12) United States Patent
Krause

(10) Patent No.: US 12,077,960 B2
(45) Date of Patent: Sep. 3, 2024

(54) STUCCO CONSTRUCTION SYSTEM

(71) Applicant: Advanced Architectural Products, LLC, Allegan, MI (US)

(72) Inventor: G. Matt Krause, Allegan, MI (US)

(73) Assignee: Advanced Architectural Products, LLC, Allegan, MI (US)

( * ) Notice: Subject to any disclaimer, the term of this patent is extended or adjusted under 35 U.S.C. 154(b) by 73 days.

(21) Appl. No.: 17/706,550

(22) Filed: Mar. 28, 2022

(65) Prior Publication Data

US 2022/0307256 A1 Sep. 29, 2022

Related U.S. Application Data

(60) Provisional application No. 63/166,798, filed on Mar. 26, 2021.

(51) Int. Cl.

| | |
|---|---|
| ***E04B 1/41*** | (2006.01) |
| ***E04B 1/38*** | (2006.01) |
| ***E04B 1/76*** | (2006.01) |
| ***E04F 13/04*** | (2006.01) |

(52) U.S. Cl.

CPC ..... *E04B 1/388* (2023.08); *E04B 1/76* (2013.01); *E04F 13/04* (2013.01); *E04B 2001/389* (2023.08)

(58) Field of Classification Search

CPC ..... E04B 1/388; E04B 1/76; E04B 2001/389; E04F 13/04

USPC ..... 52/302.3

See application file for complete search history.

(56) References Cited

U.S. PATENT DOCUMENTS

| | | | | |
|---|---|---|---|---|
| D780,942 | S * | 3/2017 | Krause | E04B 1/7629 D25/119 |
| 9,624,666 | B2 * | 4/2017 | Singleton | E04B 2/58 |
| 2008/0104918 | A1 * | 5/2008 | Gleeson | E04F 13/08 52/489.1 |
| 2012/0167505 | A1 * | 7/2012 | Krause | E04F 13/0817 52/302.1 |
| 2013/0152498 | A1 * | 6/2013 | Krause | E04B 1/7629 52/235 |
| 2013/0174506 | A1 * | 7/2013 | Bombino | E04B 1/388 52/750 |
| 2015/0191910 | A1 * | 7/2015 | Bordener | E04F 13/08 52/772 |

(Continued)

*Primary Examiner* — Brian E Glessner
*Assistant Examiner* — James J Buckle, Jr.
(74) *Attorney, Agent, or Firm* — The Watson IP Group, PLC; Jovan N. Jovanovic

(57) ABSTRACT

A stucco construction system and method of installing the stucco construction system that includes a substrate, a first sheathing, a plurality of brackets, a plurality of insulation panels, a second sheathing and a stucco layer. The substrate has a first side and a second side. The first sheathing extends over the second side of the substrate. The plurality of brackets is positioned on the second side of the first sheathing and are coupled to one of the substrate and the first sheathing. The plurality of brackets are spaced apart from each other. The plurality of insulation panels is positioned such that each insulation panel is positioned between the plurality of brackets. The second sheathing extends over the plurality of brackets and the insulation panels and is attached to the plurality of brackets. The stucco layer is disposed over the second sheathing.

15 Claims, 8 Drawing Sheets

(56) References Cited

U.S. PATENT DOCUMENTS

| | | | | |
|---|---|---|---|---|
| 2016/0208479 | A1* | 7/2016 | Krause | E04F 13/0803 |
| 2019/0153733 | A1* | 5/2019 | Krause | E04B 1/7654 |

* cited by examiner

STUCCO CONSTRUCTION SYSTEM

CROSS-REFERENCE TO RELATED APPLICATION

This application claims priority to U.S. Patent Application Ser. No. 63/166,798, filed Mar. 26, 2021, entitled "STUCCO CONSTRUCTION SYSTEM", the entire specification of which is hereby incorporated by reference.

BACKGROUND OF THE DISCLOSURE

1. Field of the Disclosure

The disclosure relates in general to a construction system, and more particularly, to a stucco construction system.

2. Background Art

Stucco construction systems include a decorative coating for walls and ceilings, serving as an external building siding (all referred hereto as wall or walls). Stucco construction systems are typically used to cover a less visually appealing construction substrate made out of various materials, such as metal, gypsum board, concrete, cinder block, clay brick, and adobe.

While highly decorative, in many instances, fasteners are utilized within the construction of the wall. While the fasteners are embedded within the exterior of the wall, and covered by stucco, in many instances they can nevertheless deteriorate and lead to discoloration of the surface of the stucco and may be difficult to repair, repaint or otherwise ameliorate.

One such deficiency with typical stucco construction systems is that they allow for thermal transmission, often, through fasteners. In many instances this is because there is a large thermal gradient between an interior (often cooler) and an exterior (often warmer). Due to this gradient, moisture can migrate along the fastener for example, and the fastener may have a temperature that is lower than the dew point of the temperature of the surroundings. In such an instance, this can lead locations for preferred nucleation of condensate to occur. In turn, the fasteners can rust, and the rust (i.e., including the rust color) can permeate through the stucco and discolor the outer surface that is visible.

BRIEF DESCRIPTION OF THE DRAWINGS

The disclosure will now be described with reference to the drawings wherein.

SUMMARY OF THE DISCLOSURE

Figure 1:
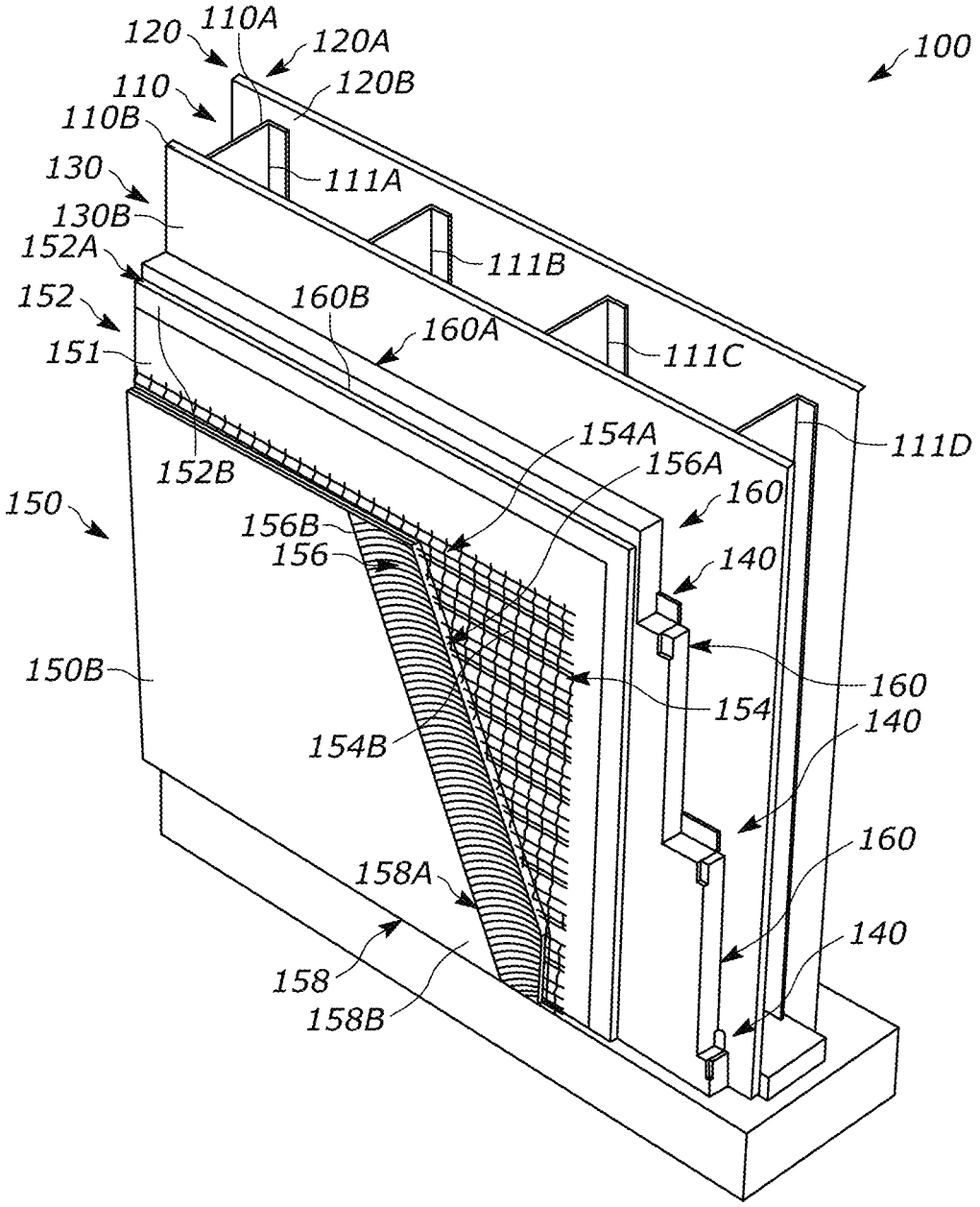
FIG. 1 illustrates an isometric view of a first example of a stucco construction system, in accordance with at least one configuration.

The disclosure is directed to a stucco construction system comprising a substrate, a first sheathing, a plurality of brackets, a plurality of insulation panels, a second sheathing and a stucco layer. The substrate has a first side and a second side. The first sheathing extends over the second side of the substrate. The first sheathing has a first side and a second side. The plurality of brackets is positioned on the second side of the first sheathing and are coupled to one of the substrate and the first sheathing. Additionally, the plurality of brackets being spaced apart from each other. The plurality of insulation panels are positioned such that each insulation panel is positioned between the plurality of brackets. The second sheathing extends over the plurality of brackets and the insulation panels and is attached to the plurality of brackets capturing the insulation panels between the first sheathing, the second sheathing and the plurality of brackets. The stucco layer is disposed over the second sheathing.

In some configurations, the plurality of brackets comprise a pultruded profile that includes both stranded members and woven members within a resin matrix.

In some configurations, the bracket further includes a first end wall, a body wall and a second end wall. The first end wall overlays the first sheathing. The body wall extends from the first end wall. The second end wall is opposite the first end wall. The second end wall and the first end wall are substantially parallel, with the body wall being one of oblique, substantially perpendicular and perpendicular thereto.

In some configurations, the construction further includes a fastener retention member positioned on at least one of an outer and an inner surface of at least one of the first end wall and the second end wall.

In some configurations, the fastener retention member comprises a first fastener retention member positioned on one of an outer surface and an inner surface of the first end wall and a second fastener retention member positioned on one of an outer surface and an inner surface of the second end wall.

In some configurations, the first fastener retention member is releasably coupled to the first end wall and wherein the second fastener retention member is releasably coupled to the second end wall.

In some configurations, each of the plurality of brackets comprises a width, the width of the plurality of brackets being two inches.

In some configurations, the substrate comprises a plurality of studs that are spaced apart from each other in a substantially parallel configuration.

In some configurations, the plurality of studs comprise at least one of a plurality of metal studs and a plurality of wood studs.

In some configurations, the plurality of brackets are generally positioned so as to be one of parallel to and perpendicular to the plurality of studs.

In some configurations, the plurality of insulation panels comprise one of a rigid insulation and a non-rigid insulation.

In some configurations, the rigid insulation comprises a polyisocyanurate insulation.

In some configurations, the first sheathing and the second sheathing comprise a gypsum board.

In some configurations, the first and second sheathing comprise a ⅝" gypsum board, the stucco comprises a stucco layer of between ⅜" and ⅝", and the plurality of insulation panels have a width of 2 inches.

In some configurations, the second sheathing is coupled to the plurality of bracket members through fasteners spaced apart from each other.

In some configurations, the plurality of fasteners comprises screws.

In some configurations, the system further includes a lath that is disposed between the stucco layer and the second sheathing.

In some configurations, the system further includes a finish layer positioned over the stucco layer.

DETAILED DESCRIPTION OF THE DISCLOSURE

While this disclosure is susceptible of configuration in many different forms, there is shown in the drawings and described herein in detail a specific configuration(s) with the understanding that the present disclosure is to be considered as an exemplification and is not intended to be limited to the configuration(s) illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, a stucco construction system is disclosed, such as stucco construction system 100. The stucco construction system 100 is comprised of a substrate 110, a sheathing 130, a plurality of brackets 140, and a stucco structure 150. The stucco construction system 100 disclosed at least mitigates thermal transmission from through fasteners and moister migration back into a cavity within the substrate 100. Such thermal transmission can lead to condensation being formed within a cavity of a substrate associated with typical stucco construction systems, that can lead to rusting of such through fasteners. Such rusting can result in discoloration of a typical finish layer associated with typical stucco construction systems, a deficiency that cannot be cured without totally replacing such rusting fasteners. Thus, the stucco construction system 100 disclosed at least mitigates deficiencies associated with typical stucco construction systems. In at least one configuration, the sheathing 130 can be interior gypsum sheathing.

The substrate 110 includes a first side 110A and a second side 110B. The second side 110B of the substrate 110 is disposed on an opposite side of the substrate 110 from the first side 110A of the substrate 110. The substrate 110 can be formed using various forms of construction materials including at least one of a metal beams, wood beams, Concrete Masonry Unit (CMU), cement, clay brick, adobe, or any other type of substrate. In at least configuration, the substrate 110 can includes a number of vertically disposed beams or studs, such as studs 111A, 111B, 111C, 111D that form the substrate 110, as shown. In at least one configuration, the studs 111A, 111B, 111C, 111D can each be a 6" 16 ga. galvanized metal stud at 12" O.C.

The sheathing 130 includes a first side 130A and a second side 130B. The second side 130B of the sheathing 130 is disposed on an opposite side of the sheathing 130 from the first side 130A of the sheathing 130. During construction of the stucco construction system 100, the first side 130A of the sheathing 130 is coupled to the second side 110B of the substrate 110. This coupling typically includes use of a plurality of fasteners (not shown), such as screws, nails, or any other type of fasteners.

Figure 2:
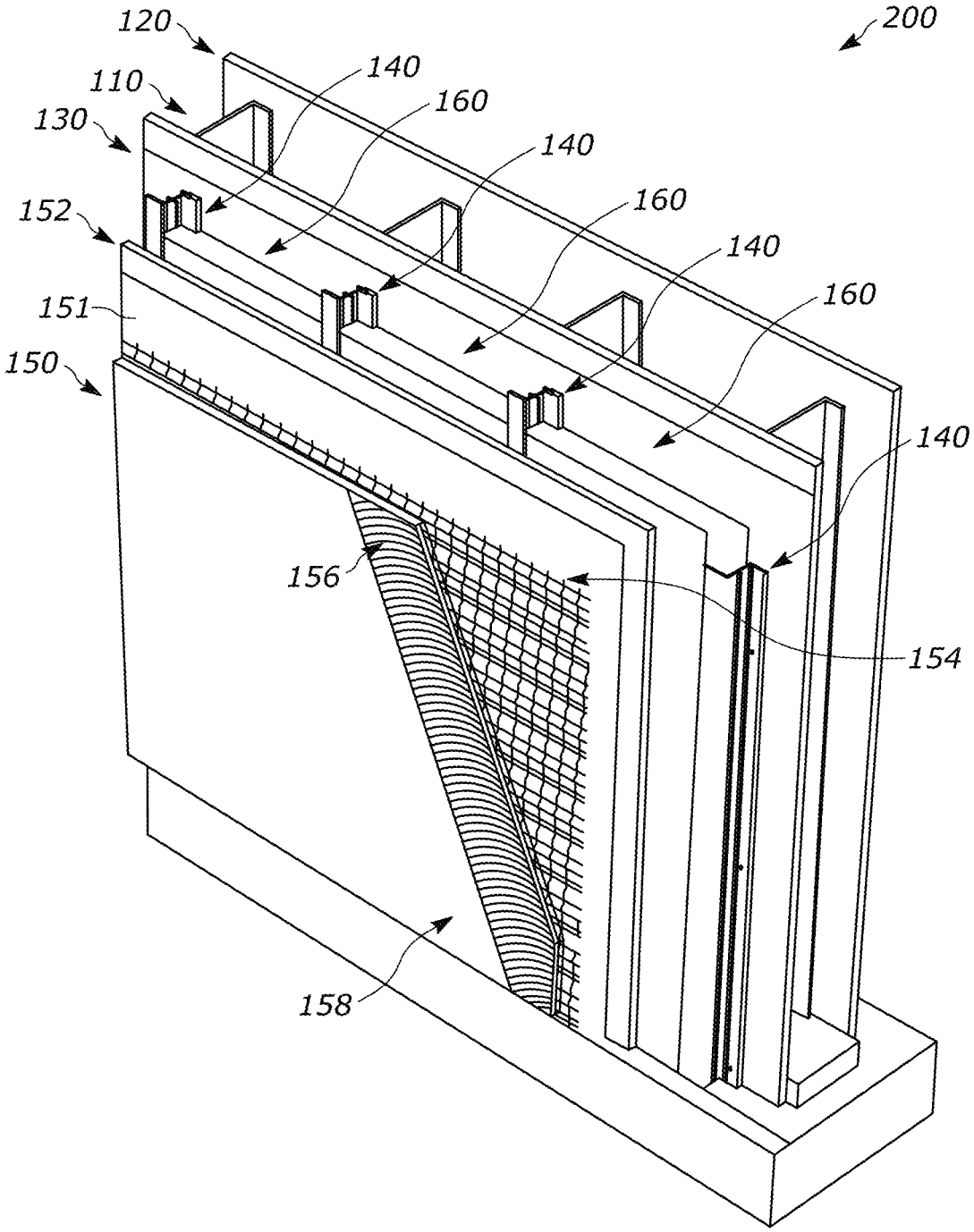
FIG. 2 illustrates a second example of a stucco construction system, in accordance with at least one configuration.
Figure 3:
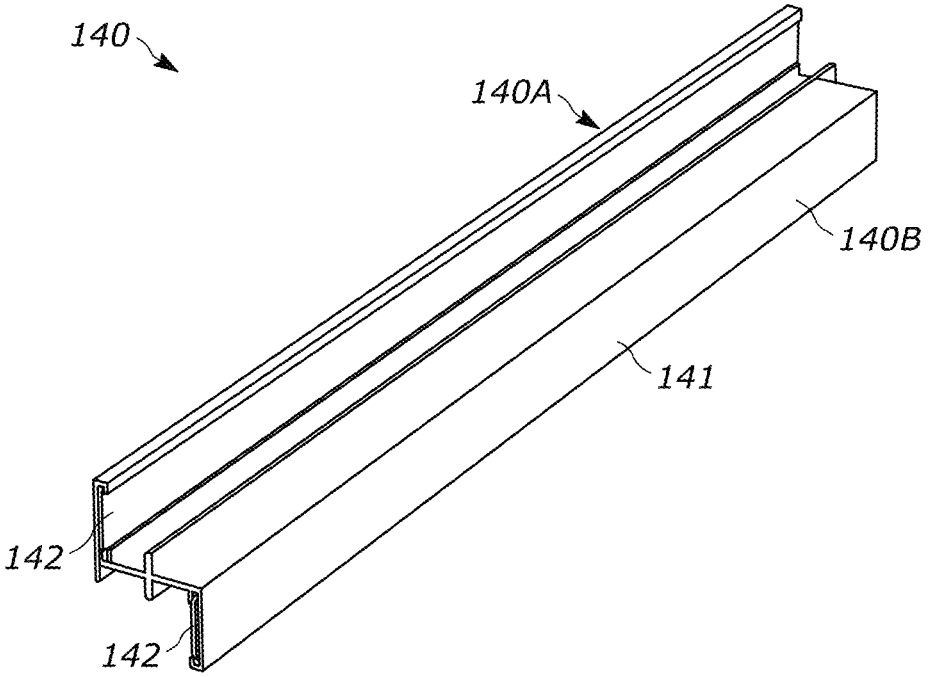
FIG. 3 illustrates an elongated isometric view of the brackets shown in FIGS. 1 and 2, in accordance with at least one configuration.

As shown in FIG. 3, the plurality of brackets 140 each include an elongated body 141, a first side 140A, and a second side 140B. The second side 140B of the plurality of brackets 140 is disposed on an opposite side of the plurality of brackets 140 from the first side 140A of the plurality of brackets 140. During construction of the stucco construction system 100, the first side 140A of the plurality of brackets 140 is coupled to the second side 130B of the sheathing 130. This coupling typically includes use of a plurality of fasteners (not shown), such as screws, nails, or any other type of fasteners. The elongated body 141 of the plurality of brackets 140 can be disposed in a substantially horizontal orientation shown in FIG. 1 and a substantially vertical orientation within in stucco construction system 200 shown in FIG. 2. Small deviations (+−5 degrees) from a perfectly vertical orientation and a perfectly horizontal orientation are possible without departing from the scope of the configurations disclosed.

Depending upon the needs of a particular construction project, in at least one configuration the stucco construction system 100 further comprises insulation, such as a plurality of insulation panels 160. The plurality of insulation panels 160 each comprising a first side 160A and a second side 160B. The second side 160B of the insulation panels 160 is disposed on an opposite side of the plurality of insulation panels 160 from the first side 160A of the plurality of insulation panels 160. During construction of the stucco construction system 100, the plurality of insulation panels 160 are disposed between the plurality of brackets 140, and also between the stucco structure 150 and the sheathing 130. The plurality of insulation panels 160 can include at least one of a rigid insulation (e.g., foam plastic insulation) and non-rigid insulation (e.g., mineral wool insulation). In at least one configuration, the insulation panels 160 can be at least one of 1.25"-4" polyisocyanurate insulation and 3-6" of fiberglass batt insulation at 16" O.C. with through fastener attachment.

Depending upon the needs of a particular construction project, in at least one configuration the stucco construction system 100 further comprises a drywall panel 120. The drywall panel 120 includes a first side 120A and a second side 120B. The second side 120B of the drywall panel 120 is disposed on an opposite side of the drywall panel 120 from the first side 120A of the drywall panel 120. During construction of the stucco construction system 100, the second side 120*b* of the drywall panel 120 is coupled to the first side 110A of the substrate 110. This coupling typically includes use of a plurality of fasteners (not shown), such as screws, nails, or any other type of fasteners. The drywall panel 120 can be made of various thicknesses and weights, with some even including fire retardant materials embedded therein.

The stucco structure 150 includes a first side 150A and a second side 150B. The second side 150B of the stucco structure 150 is disposed on an opposite side of the stucco structure 150 from the first side 150A of the stucco structure 150. During construction of the stucco construction system 100, the stucco structure 150 is coupled to the second side 140B of the plurality of brackets 140. In at least one configuration of the stucco construction system 100, the sheathing 130 described above is a first sheathing, with the stucco structure 150 being comprised of a second sheathing 152, a lath 154, a stucco layer 156, and a finish layer 158. The second sheathing 152 including a first side 152A and a second side 152B. The second side 152B of the second sheathing 152 is disposed on an opposite side of the substrate second sheathing 152 from the first side 152A of the second sheathing 152. During construction of the stucco construction system 100, the first side 152A of the second sheathing 152 is coupled to the plurality of brackets 140. This coupling typically includes use of a plurality of fasteners (not shown), such as screws, nails, or any other type of fasteners (although typically screws are utilized). In at least one configuration, the stucco layer 156 can be a ⅜" stucco layer. In at least one configuration, the second sheathing 152 can be ⅝" exterior fiberglass mat gypsum sheathing.

The lath 154 includes a first side 154A and a second side 154B. The second side 154B of the lath 154 is disposed on an opposite side of the lath 154 from the first side 154A of the lath 154. During construction of the stucco construction system 100, the first side 154A of the lath 154 is coupled to the second side 154B of the second sheathing 152, with the lath 154 being disposed perpendicular to the plurality of brackets 140. This coupling typically includes use of a plurality of fasteners (not shown), such as screws, nails, or any other type of fasteners. In at least one configuration, the lath 154 is a metal lath, although other materials are possible. In at least one configuration of the stucco construction system 100, the stucco structure 150 further includes building paper 151 disposed between the second side 152B of the second sheathing 152 and the first side 154A of the lath 154.

The stucco layer 156 including a first side 156A and a second side 156B. The second side 156B of the stucco layer 156 is disposed on an opposite side of the stucco layer 156 from the first side 156A of the stucco layer 156B. During construction of the stucco construction system 100, the first side 156A of the stucco layer 156 is coupled to the lath 154. The stucco layer 156 can include a scratch coat that is applied to the lath 154. The stucco layer 156 can further include a brown coat that is thereafter applied to the scratch coat. The finish layer 158 includes a first side 158A and a second side 158B. The second side 158B of the finish layer 158 disposed on an opposite side of the finish layer 158 from the first side 158A of the finish layer 158. During construction of the stucco construction system 100, the first side 158A of the finish layer 158 is coupled to the second side 156B of the stucco layer 156. The finish layer 158 can be troweled onto the second side 156B of the stucco layer 156.

The stucco construction system 100 can further comprise a plurality of fastener retention members 142 each comprising an elongated body 143, disposed on the plurality of brackets 140. The fastener retention members 142 can be used to reinforce the plurality of brackets 140 and provide a way to retain fasteners that are used with the plurality of brackets 140, that is provide a hard surface onto which fasteners can be secured against. In at least one configuration, the fastener retention members 142 can be metal (e.g., steel, aluminum, or any other metal) or other material that provides reinforcement and allows for retention of fasteners. In at least one configuration, the fastener retention members 142 are pre-installed with the plurality of brackets 140. In certain configurations, the insert fastener retention members 142 are installed after formation of the plurality of brackets 140, whereas in other configurations, the plurality of brackets 140 is formed over the fastener retention members 142. Preferably, the fastener retention members 142 is permitted to slidably move within the respective reinforcement channel 258, 278. In still other configurations, the insert fastener retention members 142 can be inserted into the plurality of brackets 140 by the installer at the installation site or just prior to the installation site.

Figure 4:
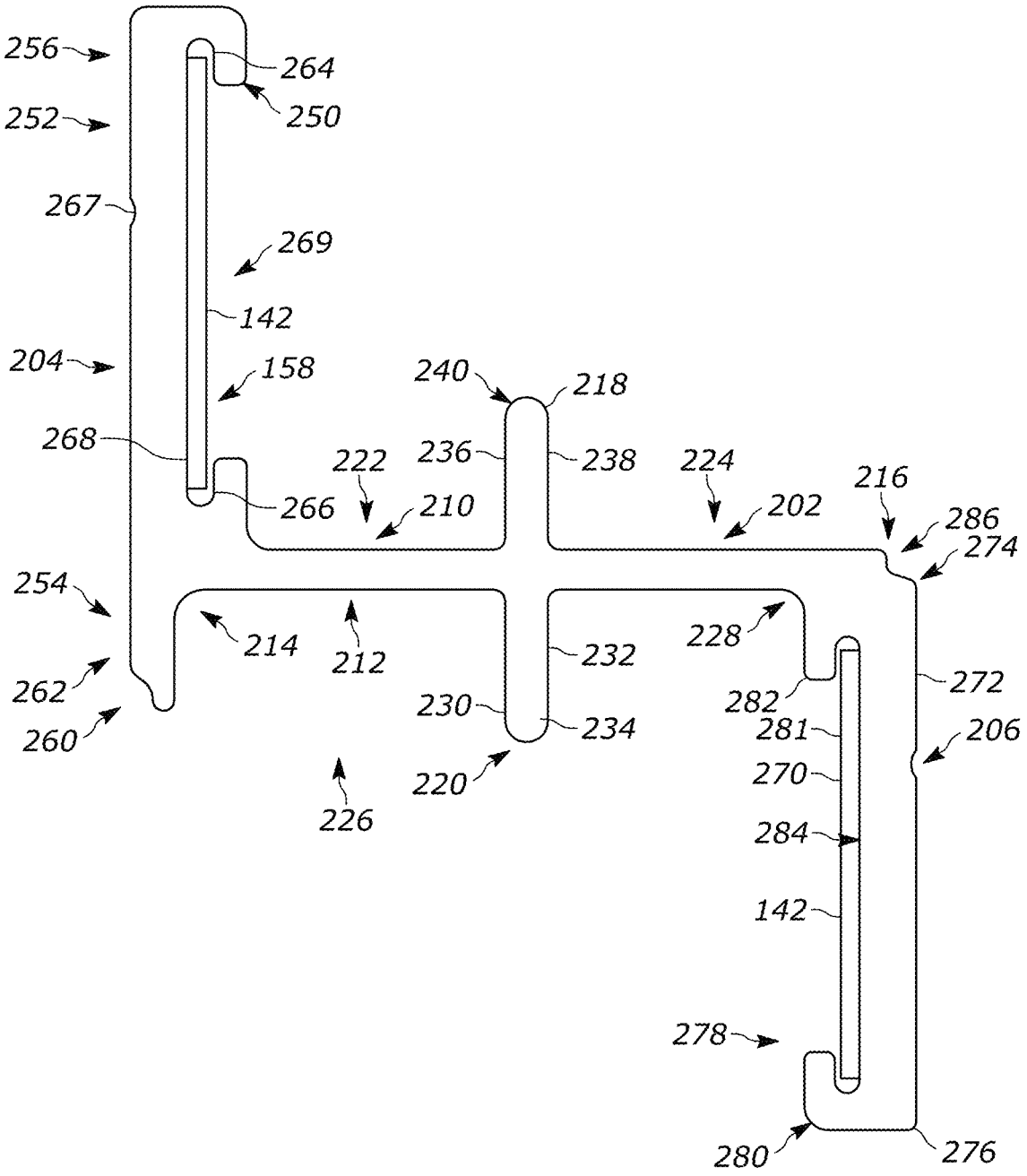
FIG. 4 illustrates a side view of an example bracket for use with the stucco construction system shown in FIGS. 1 and 2, in accordance with at least one configuration.

In at least one configuration, the plurality of brackets 140 are Z brackets. An example of such a Z bracket is shown in FIG. 4, as bracket 195. The bracket 295 (also known in the industry as a "girt") is shown in detail in FIG. 7 as cooperating with the fastener retention members 142. The bracket 295 itself comprises a polymer member, or a composite member that includes body wall 202, first end wall 204 and second end wall 206. In the configuration shown, the first end wall 204 is generally perpendicular to the body wall 202 and the end wall 206 is likewise perpendicular to the body wall 202. It is contemplated that the bracket comprises an elongated member which is of a generally uniform cross-sectional shape, with variations that may be positioned along the length thereof.

A number of different brackets are contemplated for use, including but not limited to the brackets that are disclosed and claimed in U.S. Pat. No. 8,826,620 issued to Krause, U.S. Pat. No. 8,833,025 issued to Krause; U.S. Pat. No. 9,151,052 issued to Krause; and U.S. Pat. No. 9,580,904 issued to Krause, as well as, U.S. Patent App. Pub. No. 20200284043 published to Krause, the entire disclosure of each of which is incorporated by reference herein in their entirety.

Typically, such bracket 295 may be provided in any number of standard sizes that may be from only a couple of feet long to spans that are forty to fifty feet long. It is most preferred that the bracket 295 comprise a pultruded profile that includes both stranded members and woven members within a resin matrix. It will be understood that the shape can be formed through one or more pultrusion dies to achieve the final desired configuration. It is contemplated that a single resin system may be utilized, or that multiple resin systems may be utilized. Of course, the particular configuration and application may dictate changes to the relative thicknesses and dimensions of the different components. Among other fibers, it is contemplated that the fibers may comprise glass fibers (fiberglass), carbon fibers, cellulose fibers, nylon fibers, aramid fibers, and other such reinforcing fibers.

The bracket 295 provides a thermal break. As used herein, the term "thermal break" refers to a break in like materials wherein the material disposed between like materials is comprised of a material having low thermal conductivity such as a polymeric material having a high R-value as further described below. R-values are measurements of the thermal resistance of different materials. R-values are well known by those skilled in the art of the construction and insulation industries. A high R-value indicates a highly insulative material, such as an R-value of R.2 per inch and higher. Conductive materials have a very low R-value, such as steel which exhibits a negligible or nearly non-existent R-value. In the configuration of the present disclosure, there are no like materials in contact with one another, nor is there any metal to metal contact creating a pathway for heat to transfer from the exterior to the interior and vice versa.

It is also contemplated that the bracket 295 may comprise anticorrosive polymeric materials that exhibit high insulative qualities or rather, demonstrate high R-value properties such as an R-value in the range of about R.2 to about R8 per inch. Polymeric materials suitable for the present disclosure include thermoplastics or thermoset resin materials including for example: acrylonitrile-butadiene-styrene (ABS) copolymers, vinylesters epoxies, phenolic resins, polyvinyl chlorides (PVC), polyesters, polyurethanes, polyphenylsufone resin, polyarylsulfones, polyphthalimide, polyamides, aliphatic polyketones, acrylics, polyxylenes, polypropylenes, polycarbonates, polyphthalam ides, polystyrenes, polyphenylsulfones, polyethersulfones, polyfluorocarbons, bio-resins and blends thereof. Other such thermoplastics and thermoplastic resins suitable for the present disclosure are known in the art which demonstrate high R-values and are thereby heat resistant as well as anticorrosive. Thermoplastics of the present disclosure are also contemplated using a recyclable polymer or are made of a polymeric material which is partially comprised of a renewable resource such as vegetable oil or the like in its composition when an eco-friendly or "green" bracket 295 is desired. The polymeric material of the present disclosure can also be reinforced with a reinforcing fiber as detailed below. The bracket 295 composed of the materials discussed above forms a thermal break between exterior panels and building substrates in an effort to control the temperature within a building structure by reducing or eliminating thermal conductivity from the exterior panel to the building substrate and vice versa. In assembly, the R-value of an exterior wall panel system of the present disclosure can typically exhibit an R-value from about R.2 to about R30 per inch depending on the thickness of the overall system, the insulation materials used and the composition of the bracket 295. Further, microspheres, such as polymeric or glass nanospheres, can be added to the makeup of the brackets to provide further insulative properties and increased R-value expression.

There are several different types of measurements that relate to a materials ability to insulate, resist, transmit or conduct heat across a material. Particularly, a material's K-value relates to a specific material's thermal conductivity, a material's C-value correlates to the material's thermal conductance, a material's R-value relates to a material's thermal resistance, and a U-value relates to the thermal transmittance of an overall system. In designing a wall, roof or deck bracket and panel system providing adequate insulative properties for a building structure, materials with low K-values and C-values are desired while materials with high R-values are desired. When this set of conditions is met, the overall thermal transmittance, or U-value, of the system is low. Thus, the lower the U-value, the lower the rate heat thermally bridges from one material to another. A building structure having a well-insulated system will have a much lower U-value than an uninsulated or poorly insulated system exhibiting high thermal transmittance.

Regarding the R-value of the bracket 295 of the present disclosure, a relatively high R-value is desired to ensure adequate insulation of a building structure from outside elements by making a bracket that creates a thermal break in a wall panel system. A range of R-values for the polymeric materials used to construct the bracket 295 described above would be a range of about R.2 to about R8 per inch in order to create a thermal break that effectively reduces or eliminates thermal bridging. The thermal conductivity, or K-value, is the reciprocal of the material's R-value, such that for a polymeric material exhibiting an R-value of about R.2 to R8 per inch, the correlating K-value for that material would be from about K5 to about K0.125 per inch. Thus, in comparison to present day metal brackets used in other bracket and panel systems made of iron or steel, a polymeric bracket 295 of the present disclosure will exhibit a K-value of approximately about K.5 to about K0.125 per inch at a given set of conditions as compared to a bracket made from a metallic material such as iron or steel which would have an approximate K-value as high as K32 to K60 per inch at the same conditions. This is because metallic materials, such as iron and steel, have low or negligible R-values and are well known conductors of heat. Steel is known to have an R-value of about 0.003R per inch. Thus, for example, a steel bracket compared to a polymeric bracket of the present disclosure having an R-value of R.55 would be 183 times more thermally conductive.

The body wall 202 includes top surface 210 and bottom surface 212 which extend from first end 214 to second end 216, upper rib 218 and lower rib 220. The upper rib extends outwardly from the top surface 210 between the first and second ends, bisecting the top surface into a top first end portion 222 and a top second end portion 224. The upper rib 218 preferably extends substantially perpendicularly to the top surface 210, and, includes first side 236, second side 238 and tip region 240 spanning therebetween. The first side 236 and the second side 238 are generally parallel to each other for at least a portion of the length. The size of the upper rib 218 is that it substantially matches that of the longitudinal slots 120 of the insulation panel 12, while being slightly oversized in a number of the dimensions, if not in virtually all dimensions or all dimensions. That is, preferably, the upper rib 218 has the same shape as the longitudinal slots 120 except that it is larger dimensionally than the longitudinal slots by an amount that allows for at least elastic deformation of the longitudinal slot 120 upon insertion of the upper rib 218 therein.

The lower rib 220 preferably extends substantially perpendicularly to the bottom surface 212 of the body wall 202, and, includes first side 230, second side 232 and tip region 234. The lower rib 220 is preferably positioned on the opposite side of the upper rib 218, and has the same dimensions as the upper rib. As with the upper rib, the lower rib bisects the bottom surface 212 into a bottom first end portion 226 and a bottom second end portion 228. It will be understood that the shapes of the upper and lower rib may be varied, but where the longitudinal slots 120 are substantially uniform, the upper and lower rib are each configured to facilitate at least elastic deformation of the longitudinal slot 120 upon insertion of the upper or lower rib thereinto. It is this intimate engagement along the length thereof through the elastic deformation that provides for the sealing and, in turn, the vapor barrier on opposing sides of the rib.

The first end wall 204 is positioned at the first end of the body wall 202 and, as set forth above, is preferably perpendicular to the body wall 202. In the configuration shown, the first end wall extends downwardly from the bottom surface 212, and projects downwardly beyond the bottom surface 212 to define a lower flange portion 262. In certain configurations, it is helpful to line an inside surface of the lower flange portion 262 with an adhesive or sealant (such as butyl rubber). The first end wall 204 includes inside surface 250, outside surface 252, and extends from lower end 254 to upper end 256. The upper end 256 includes lower flange portion 262. It is contemplated that the lower flange portion 262 extends upwardly a distance sufficient to provide an effective surface for the application and retention of an adhesive or sealant.

The lower flange portion 262 at a lower end on the outside surface 252 thereof includes a capillary break 260 (in the form of a relief portion which tapers toward the upper edge). As set forth in the incorporated references, the capillary breaks the water tension between it and the cladding or building substrate with which it is in contact so as to act as anti-capillary action grooves for water trapped therebetween or drawn into the joints.

A first reinforcement channel 258 is defined on one of the inside surface and the outside surface of the first end wall, and preferably on the inside surface thereof. The first reinforcement channel 258 includes upper clip portion 264 and lower clip portion 266 spanned on one side by surface 268 and open to the other side defining slot 269. The channel is generally parallel to the outside surface 252 and generally extends the entirety of the inside surface 250 below the bottom surface 212 of the body wall 202.

As will be explained below, the fastener retention members 142 is slidably introduced into the first reinforcement channel 258. In certain configurations, the fastener retention members 142 is relatively snug within the first reinforcement channel 258. Preferably, the fastener retention members 142 comprises a metal member, such as an aluminum, magnesium, steel, galvanized steel or another material. Of course, it is contemplated that the fastener retention members 142 comprises a composite member of a configuration that is the same or different than that of the bracket 295. It is preferred that the fastener retention members 142 comprises a member of ductility sufficient so as to receive and be pierced by a fastener or the like, while retaining the fastener therein.

It will further be understood that a guide notch 267 extends on the outside surface 252 and along the length thereof. The guide notch 267 is provided so as to provide a user with a tactile feel for where to begin the insertion of a fastener. By initiating a fastener at the guide notch, it is such that the fastener will be directed into contact at an appropriate portion of the fastener retention members 142 positioned within the first reinforcement channel 258.

The second end wall 206 as shown in FIG. 4 is positioned at the second end of the body wall 202, and is preferably perpendicular to the body wall 202 (and parallel to the first end wall 204), although it is contemplated that they may be oblique to each other as well, as well as substantially perpendicular (i.e., +/−10°). In the configuration shown, the second end wall extends downwardly from the bottom surface 212 of the body wall 202. The second end wall 206 includes inside surface 270 and outside surface 272 which extend from inner end 274 (which is at the junction with the body wall 202), to outer end 276. A capillary break 286 having a configuration that matches the capillary break 260 of the first end wall 204.

A second reinforcement channel 278 is defined in one of the inside surface and the outside surface of the second end wall, and preferably on the inside surface thereof. The second reinforcement channel 278 includes outer clip portion 280 and inner clip portion 282 which are spanned on one side by surface 284 and which define slot 281 on the other side thereof. The channel is generally parallel to the outside surface 272 of the second end wall, and generally extends the entirety of the inside surface below the lower surface 212 of the body wall 202.

As with the first end wall 204 above, another of the fastener retention members 142 is slidably introduced into the second reinforcement channel 278, preferably, relatively snug therewithin. Preferably, the same materials are utilized for both of the fastener retention members 142 shown.

Some testing was completed with a wall having a configuration of the type that is disclosed herein. In particular, the wall configuration comprised a ⅜" stucco on a ⅝" exterior gypsum sheathing. The exterior gypsum sheathing was installed on a plurality of spaced out brackets of the type disclosed herein having a width of 2". The brackets were positioned parallel to each other (either vertically or horizontally), spaced at 16" on center, with 2" of polyisocyanurate insulation positioned between each of the brackets. The brackets are mounted on 6" 16 gauge galvanized metal studs which form a framing, and which are positioned 12" on center. Finally, an interior gypsum sheathing was utilized on the opposite end of the metal stud framing, with no insulation within the cavity created by the spaced apart galvanized metal studs.

Testing was done on the utilizing standard tabulated values of constant thermal conductivities that were based upon values from the 2009 ASHRAE Handbook—Fundamentals. The thermal conductivity of the bracket is based upon ASTM C177 testing results. The contact resistances between different materials were based on ASHRAE Report "Thermal performance of building envelope details for Mid—and—High—Rist Buildings (1365 RP). The three dimensional modeling was done by utilizing SolidWorks Simulation software, which is a finite element analysis (FEA) package. A steady state conduction model was utilized.

The temperatures and relative humidity values that are utilized are based upon criteria listed as average temperatures and relative humidity in the Stucco Institute Report entitled "A Summary of Moisture Effects Behind Florida Stucco Systems." Two different temperatures were utilized a temperature of 88.5 F (ambient temperature) and a 120 F (heat gain) at an interior temperature 70 F.

Figure 5:
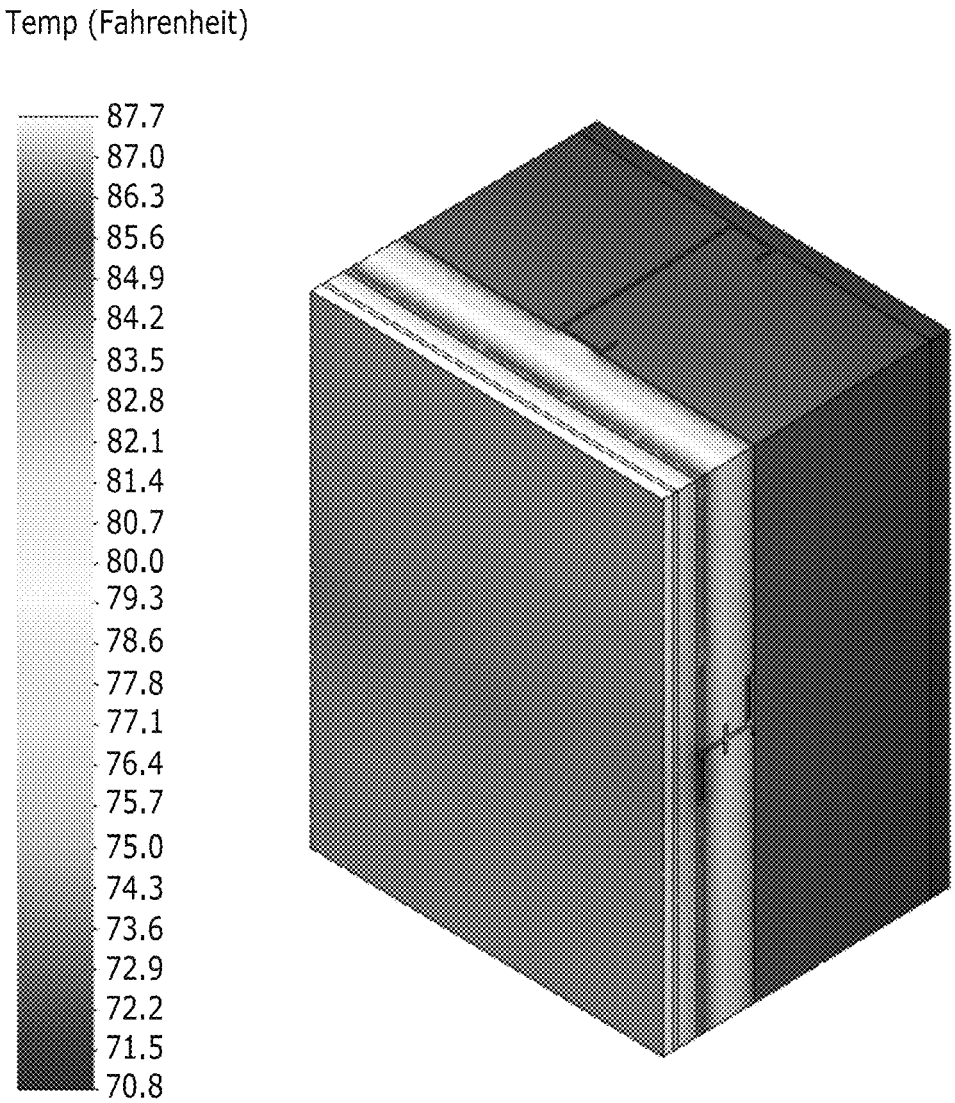
FIG. 5 illustrates a perspective view of a thermal gradient at an exterior temperature of 88.5 F.
Figure 6:
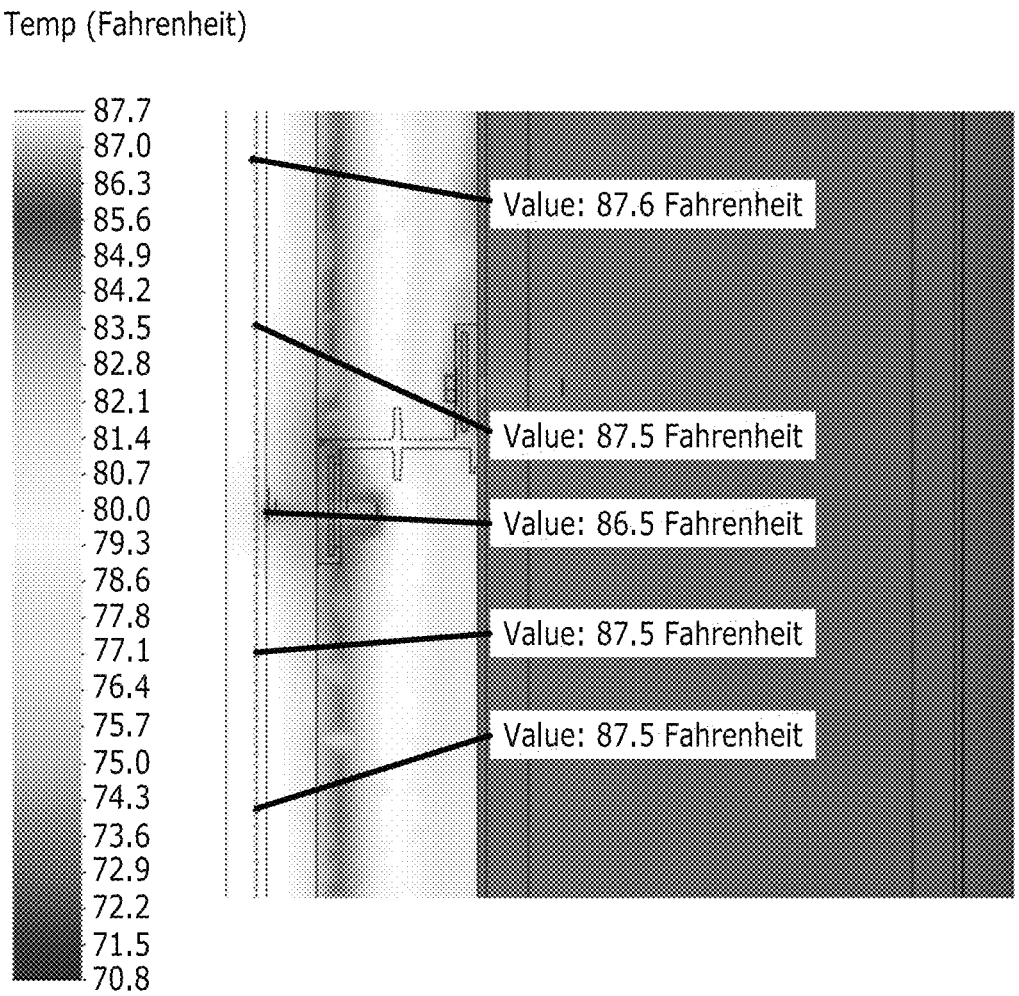
FIG. 6 illustrates a cross-sectional view of the thermal gradient of an exterior temperature of 88.5 F.
Figure 7:
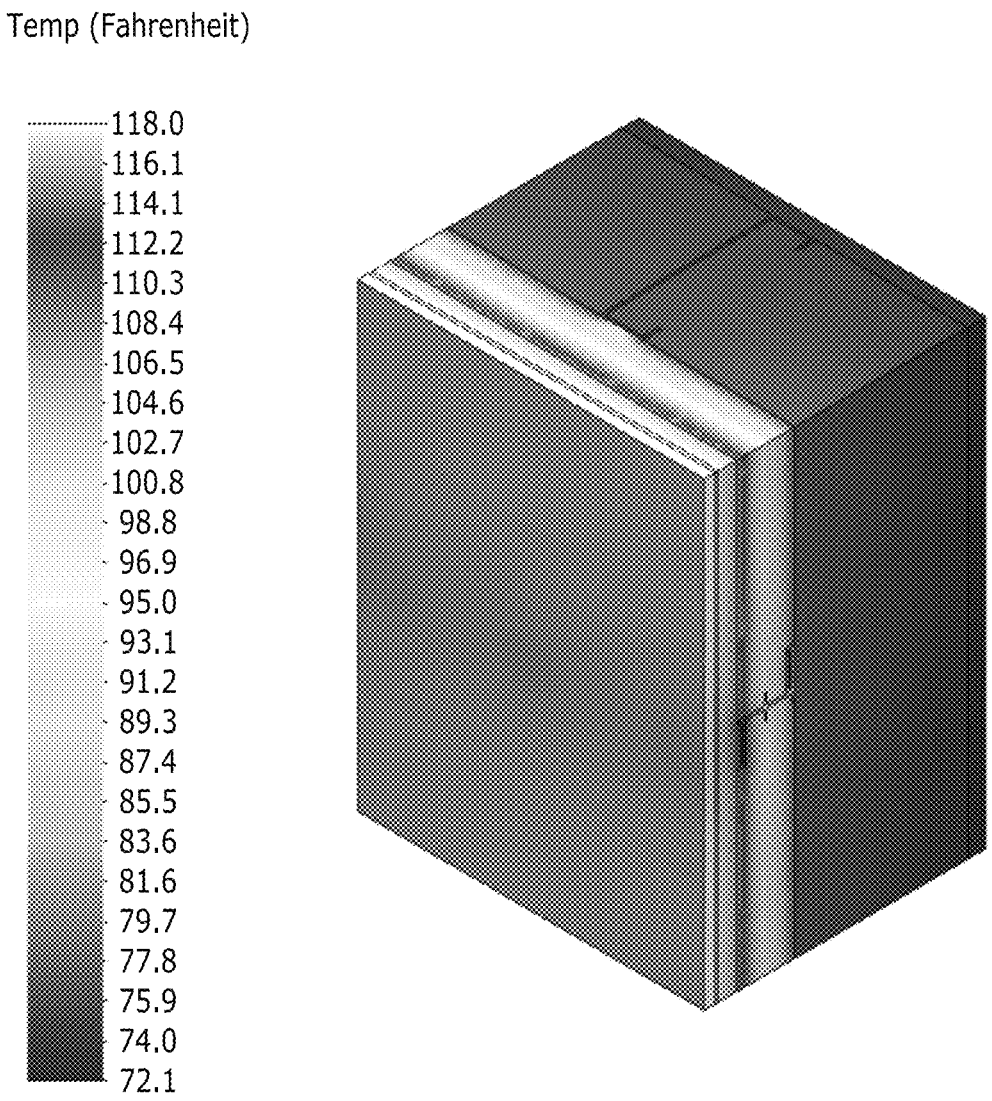
FIG. 7 illustrates a perspective view of a thermal gradient at an exterior temperature of 120 F.
Figure 8:
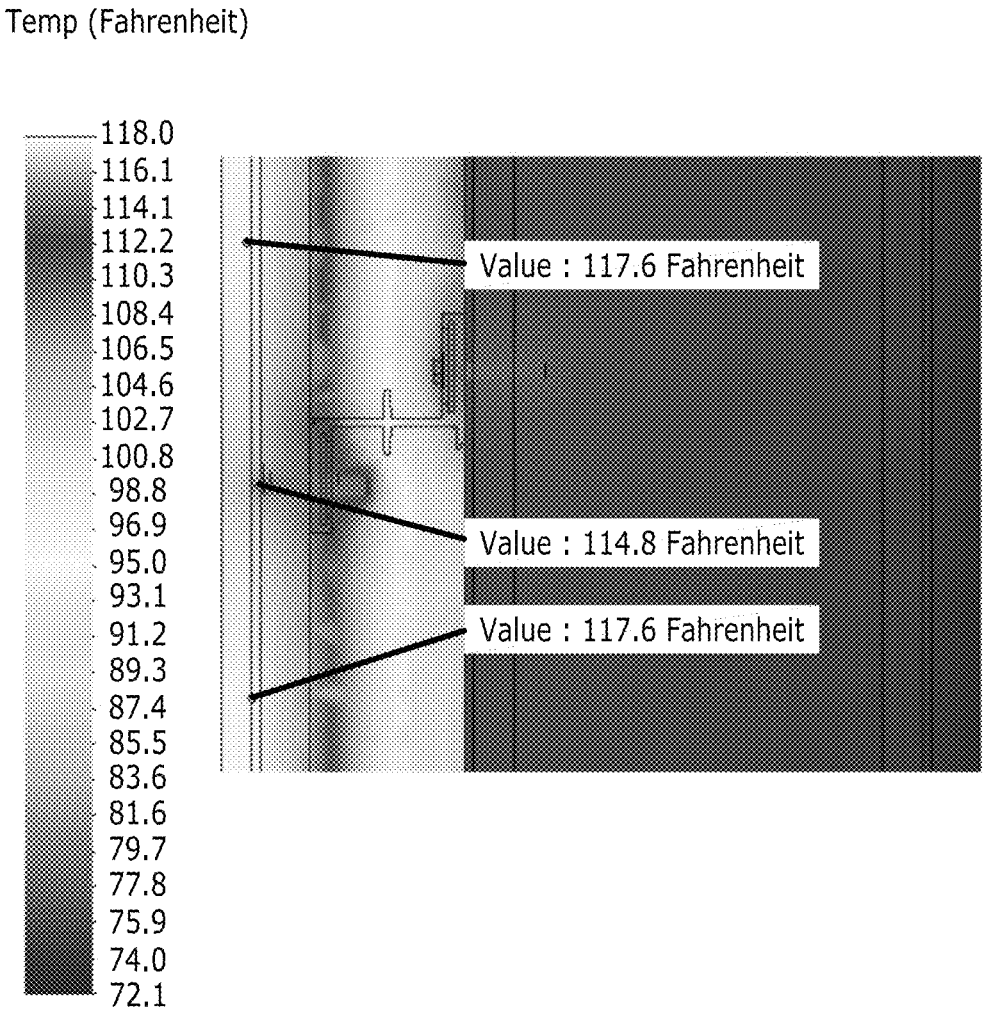
FIG. 8 illustrates a cross-sectional view of a thermal gradient at an exterior temperature of 120 F.

As a result of the testing, a temperature gradient at 88.5 F can be seen in FIG. 5 in a perspective view and in FIG. 6 in a cross-sectional view, and, a temperature gradient at 120 F can be seen in FIG. 7 in a perspective view and in FIG. 8 in a cross-sectional view. The temperature values are shown for discrete temperature readings (i.e., 88.5 F and 120 F). The determined R-value was 14.97 ($hr*ft^2*F/BTU$). The effective U Factor was 0.0668 ($BTU/hr*ft^2*F$). The thermal efficiency was determined to be 91.51%.

Additionally, utilizing a relative humidity of 90% at 88.5 F is 85 F. The dew point at 70% relative humidity and 120 F is approximately 107.5 F. In both cases, the fasteners (i.e., the exterior of the system) are above the dew points for such average temperatures and humidity. Thus, there is no location on the fasteners creating a location for preferred nucleation of condensate to occur. In other words, the fasteners will not have condensate forming thereon, which, in turn, leads to rusting of the fasteners and discoloration of the stucco by having the rust bleed (or otherwise permeate) to the surface of the stucco.

Additionally, the foregoing configuration meets the ASHRAE 90.1 maximum U factor of 0.084 for climate zone 2. Additionally, the foregoing configuration also does meet the climate zone 3 requirement of 0.077.

By comparison, three alternate assemblies were configured, which alternate assemblies substantially correspond to commonly configured wall constructions.

Alternate assembly one was configured as follows: a ⅜" stucco on a ⅝" exterior gypsum sheathing. The gypsum sheathing was mounted on 16 gauge galvanized metal zee furrings with 1" of polyisocyanurate insulation. The metal zee's were positioned at 16" on center. The metal zee's were mounted to 6" 16 gauge galvanized metal stud framing at 12" on center. 3 ½" of fiberglass batt insulation and interior gypsum sheathing completed the configuration.

Alternate assembly two was configured as follows: a ⅜" stucco on a ⅝" exterior gypsum sheathing. The gypsum sheathing was mounted on 1" of polyisocyanurate insulation at 16" on center with through fastener attachment to 6" 16 gauge galvanized metal stud framing at 12" on center. 3 ½" of fiberglass batt insulation and interior gypsum sheathing completed the configuration.

Alternate assembly three was configured as follows: ⅜" stucco on a ⅝" exterior gypsum sheathing. The gypsum sheathing was mounted on 6" 16 gauge galvanized metal stud framing at 12" on center, with 6" of fiberglass bat insulation and interior gypsum sheathing.

The same testing was undertaken at 88.5 F and at 120F. The results of the R-values, the U-values and the thermal efficiency are reproduced below:

| Section | Effective R-Value (hr * ft$^2$ * ° F./BTU) | Effective U Factor (BTU/hr * ft$^2$ * ° F.) | Thermal efficiency % |
|---|---|---|---|
| SMARTci assembly: 2" SMARTci with 2" of polyiso and no batt insulation | 14.97 | 0.0668 | 91.51% |
| Alternate assembly #1: Metal zee with 1" polyiso and 3½" of batt insulation | 8.74 | 0.1144 | 39.07% |
| Alternate assembly #2: Through-fastened 1" polyiso and 3½" of batt insulation | 11.65 | 0.086 | 52.09% |
| Alternate assembly #3: Stucco directly attached to stud with 6" of batt insulation | 8.05 | 0.1242 | 37.51% |

As can be seen, the first assembly, in accordance with the present disclosure greatly outperformed the three alternate assemblies. In all three alternate assemblies, not only is the thermal efficiency substantially lower as compared to that of the present disclosure, but none of the three alternate configurations (all in common use today) meet the ASHRAE 90.1 maximum U factor for climate zones 2 or 3. Additionally, each of the alternate assemblies have the fasteners at the exterior assembly that are at temperatures below the dew point at each of the 88.5 F and the 120 F, such that these are locations for preferred nucleation of condensate to occur. Thus, in each of the foregoing, it is highly likely that fastener rusting is of heightened concern, which then leads to discoloration of the stucco around the fasteners, as well as degradation to the internal structure.

The foregoing description merely explains and illustrates the disclosure and the disclosure is not limited thereto except insofar as the appended claims are so limited, as those skilled in the art who have the disclosure before them will be able to make modifications without departing from the scope of the disclosure.

What is claimed is:

1. A stucco construction system, comprising: a substrate having a first side and a second side; a first sheathing extending over the second side of the substrate, the first sheathing having a first side and a second side; a plurality of brackets positioned on the second side of the first sheathing and coupled to one of the substrate and the first sheathing, the plurality of brackets being spaced apart from each other, each of the plurality of brackets comprising an integrally formed pultruded profile of fibers within a resin matrix, each bracket including a first end wall overlying the first sheathing, a body wall extending from the first end wall and a second end wall opposite the first end wall, the second end wall and the first end wall being substantially parallel with the body wall being one of oblique, substantially perpendicular and perpendicular thereto, the first end wall attached to the first sheathing with a first fastener, the first fastener being spaced apart from the second end wall; a plurality of insulation panels with each insulation panel being positioned between the plurality of brackets; a second sheathing extending over an outer surface of the second end wall and attached to the second end wall with a second fastener, the second fastener terminating in a spaced apart orientation from the first end wall, and the first sheathing, capturing the insulation panels between the first sheathing, the second sheathing and the plurality of brackets; a metal lath positioned over the second sheathing, the lath attached to at least one of the second sheathing and the second end wall: and a stucco layer disposed over the second sheathing and the metal lath.

2. The stucco construction system of claim 1 wherein the plurality of brackets comprise a pultruded profile that includes both stranded members and woven members within a resin matrix.

3. The stucco construction of claim 1 further comprising a fastener retention member positioned on at least one of an outer and an inner surface of at least one of the first end wall and the second end wall.

4. The stucco construction of claim 3 wherein the fastener retention member comprises a first fastener retention member positioned on one of an outer surface and an inner surface of the first end wall and a second fastener retention member positioned on one of an outer surface and an inner surface of the second end wall.

5. The stucco construction of claim 4 wherein the first fastener retention member is releasably coupled to the first end wall and wherein the second fastener retention member is releasably coupled to the second end wall.

6. The stucco construction of claim 2 wherein each of the plurality of brackets comprises a width, the width of the plurality of brackets being two inches.

7. The stucco construction of claim 1 wherein the substrate comprises a plurality of studs that are spaced apart from each other in a substantially parallel configuration.

8. The stucco construction of claim 7 wherein the plurality of studs comprise at least one of a plurality of metal studs and a plurality of wood studs.

9. The stucco construction of claim 7 wherein the plurality of brackets are generally positioned so as to be one of parallel to and perpendicular to the plurality of studs.

10. The stucco construction of claim 1 wherein the plurality of insulation panels comprise one of a rigid insulation and a non-rigid insulation.

11. The stucco construction of claim 10 wherein the rigid insulation comprises a polyisocyanurate insulation.

12. The stucco construction of claim 1 wherein the first sheathing and the second sheathing comprise a gypsum board.

13. The stucco construction of claim 1 wherein the first and second sheathing comprise a gypsum board having a thickness of ⅝", the stucco comprises a stucco layer having a thickness of between ⅜" and ⅝", and the plurality of insulation panels have a width of 2 inches.

14. The stucco construction system of claim 1 wherein the second sheathing is coupled to the plurality of bracket members through fasteners spaced apart from each other.

15. The stucco construction system of claim 1 further including a finish layer positioned over the stucco layer.

* * * * *